US012638234B2

(12) United States Patent
Berra et al.

(10) Patent No.: US 12,638,234 B2
(45) Date of Patent: May 26, 2026

(54) SYSTEM FOR STORING AND PRODUCING ENERGY TO STABILIZE THE POWER NETWORK

(71) Applicant: SAIPEM S.P.A., Milan (IT)

(72) Inventors: Matteo Berra, Milan (IT); Lorenzo Bruno, Milan (IT)

(73) Assignee: SAIPEM S.P.A., Milan (IT)

( * ) Notice: Subject to any disclaimer, the term of this patent is extended or adjusted under 35 U.S.C. 154(b) by 129 days.

(21) Appl. No.: 18/259,838

(22) PCT Filed: Dec. 27, 2021

(86) PCT No.: PCT/IB2021/062336
§ 371 (c)(1),
(2) Date: Jun. 29, 2023

(87) PCT Pub. No.: WO2022/144748
PCT Pub. Date: Jul. 7, 2022

(65) Prior Publication Data

US 2024/0060717 A1 Feb. 22, 2024

(30) Foreign Application Priority Data

Dec. 29, 2020 (IT) ..... 102020000032657

(51) Int. Cl.
*F25J 1/00* (2006.01)
*F23L 7/00* (2006.01)
(Continued)

(52) U.S. Cl.
CPC ..... *F25J 1/0012* (2013.01); *F23L 7/007* (2013.01); *F25J 1/0017* (2013.01); *F25J 1/0035* (2013.01); *F25J 1/0042* (2013.01); *F25J 1/0221* (2013.01); *F25J 1/0222* (2013.01); *F25J 1/0235* (2013.01); *F25J 1/0251* (2013.01); *F25J 3/0409* (2013.01);
(Continued)

(58) Field of Classification Search
CPC ..... F25J 1/0221; F25J 1/0222; F25J 1/0223; F25J 1/0224; F25J 1/0235; F25J 1/0236; F25J 1/0237; F25J 1/0238; F25J 1/0022; F25J 1/0012; F25J 1/0017; F25J 3/0409; F25J 2260/80; F25J 2220/82; F25J 1/0251
See application file for complete search history.

(56) References Cited

U.S. PATENT DOCUMENTS 5,303,556 A * 4/1994 Dray ..... F25J 3/04339 62/901
5,664,411 A 9/1997 Shao
(Continued)

FOREIGN PATENT DOCUMENTS

CA 2567586 A1 4/2008
CN 207420649 U 5/2018
(Continued)

OTHER PUBLICATIONS

International Search Report for International Patent Application No. PCT/IB2021/062336, mailed Jul. 25, 2022.

*Primary Examiner* — Alain Chau
(74) *Attorney, Agent, or Firm* — Armstrong Teasdale LLP

(57) ABSTRACT

A system for storing or producing electricity, which allows stabilization of a power network under conditions of excess availability of electricity or lack thereof and for producing liquefied natural gas is provided.

6 Claims, 2 Drawing Sheets

(51) Int. Cl.
*F25J 1/02* (2006.01)
*F25J 3/04* (2006.01)

(52) U.S. Cl.
CPC ..... *F25J 3/04533* (2013.01); *F25J 3/04612* (2013.01); *F25J 1/0022* (2013.01); *F25J 2210/40* (2013.01); *F25J 2210/50* (2013.01); *F25J 2220/80* (2013.01)

(56) References Cited

U.S. PATENT DOCUMENTS 5,666,823 A * 9/1997 Smith ..... F25J 3/0409 62/646
5,832,748 A 11/1998 Bonaquist
6,131,407 A 10/2000 Wissolik
6,691,532 B2 * 2/2004 Stringer ..... F25J 3/0409 62/643
7,552,599 B2 * 6/2009 Herron ..... F25J 1/0292 62/646
7,712,331 B2 * 5/2010 Dee ..... F25J 3/04412 62/643
10,288,346 B2 * 5/2019 Guillard ..... F25J 1/0037
12,065,962 B2 * 8/2024 Alford ..... F25J 1/0251
2003/0089126 A1 * 5/2003 Stringer ..... F25J 3/04303 62/643
2008/0000266 A1 * 1/2008 Dee ..... F25J 1/0015 62/643
2008/0216512 A1 * 9/2008 Herron ..... F25J 3/04854 62/651
2011/0100055 A1 5/2011 Brigham et al.
2014/0245779 A1 9/2014 Bohra et al.
2015/0226094 A1 8/2015 Alekseev
2018/0038641 A1 * 2/2018 Guillard ..... F25J 1/0234
2018/0073804 A1 * 3/2018 Allam ..... F25J 3/04181
2021/0372322 A1 * 12/2021 Alford ..... F25J 1/0242

FOREIGN PATENT DOCUMENTS

DE 19728151 A1 1/1999
FR 2972793 A1 9/2012
JP 2009203860 A 9/2009
KR 102147234 B1 8/2020
WO 2022070125 A1 4/2022

* cited by examiner

SYSTEM FOR STORING AND PRODUCING ENERGY TO STABILIZE THE POWER NETWORK

CROSS-REFERENCE TO RELATED APPLICATIONS

This application is a National Stage Application of International Patent Application No. PCT/IB2021/062336, having an International Filing Date of Dec. 27, 2021, which claims priority to Italian Application No. 102020000032657, filed Dec. 29, 2020, the entire contents of each of which are hereby incorporated by reference herein.

TECHNICAL FIELD OF THE INVENTION

The present invention finds application in the management of electricity demand peaks or shortages.

BACKGROUND ART

There are many technologies for storing electricity: electrochemical methods (batteries), mechanical (flywheels, compressed air, accumulation of water at heights), thermodynamic methods (liquefied gas: liquid air, referred to as Liquid Air Energy Storage (LAES)).

Furthermore, it is possible to produce energy from a fuel by sequestering combustion $CO_2$, through carbon capture techniques from combustion fumes, or through combustion in a synthetic atmosphere consisting mainly of $CO_2$ and oxygen (oxy-combustion): the fuel and oxygen are converted into $CO_2$ and water, then removed from the system.

The operation of a turbogas oxy-combustion plant according to the Graz cycle can be described through the following steps:

1) burning a fuel in an appropriate combustor in an atmosphere of $CO_2$, $H_2O$, and $O_2$ at high pressure, with the conversion of the fuel and oxygen to carbon dioxide and water,
2) expanding the combustion gases in a machine which produces power and reduces the temperature of the combustion gases,
3) recovering heat from the exhaust fumes by means of a Rankine steam cycle,
4) further expanding the fumes in a power-producing machine,
5) condensing the water vapor from the fumes expanded in the preceding step,
6) re-compressing the exhaust fumes, consisting of $CO_2$ and water, through a sequence of compression stages; at the appropriate pressure, the $CO_2$ produced in the combustion is tapped and sent to the sequestration operations; the remaining part of the exhaust fumes are further compressed until reaching an appropriate temperature, at which an inter-stage refrigeration is performed with the water forming the motor fluid of the Rankine cycle,
7) finally compressing the remaining part of the exhaust gases to combustor pressure,
8) recycling the exhaust gases to the combustor,
9) instead, the water condensed mentioned under 5) is pumped (the excess amount formed in the combustion is instead removed from the system) and pre-heated in the inter-stage refrigeration operation mentioned under 6), 10) then treating it according to known methods to make it suitable for steam generation,
11) then pumping it at high pressure and sending it to the heat recovery mentioned under 3), where it becomes steam,
12) expanding the steam in a turbine up to the pressure of the combustor mentioned under 1), and injected into the latter.

The process of producing $O_2$ fed to the combustor belongs to the prior art, and cryogenic air distillation is typically employed for large amounts.

An alternative to the Graz cycle, in which a steam Rankine cycle is used which involves the release of large quantities of heat at low temperature and which affects the efficiency of heat recovery, is the Allam cycle in which the elimination of such a Rankine cycle is suggested.

In particular, this comprises:

1) burning a fuel in an appropriate combustor in an atmosphere of $CO_2$, $H_2O$, and $O_2$ at high pressure, with the conversion of the fuel and oxygen to carbon dioxide and water,
2) expanding the combustion gases in a machine which produces power and reduces the temperature of the combustion gases,
3) recovering heat from the exhaust fumes by means of the carbon dioxide recirculated to the combustor mentioned under 1),
4) further cooling the exhaust fumes and separating the condensed water,
5) re-compressing the exhaust fumes, mainly consisting of $CO_2$ to supercritical pressure,
6) cooling the fumes mentioned under 5) to sub-critical temperature,
7) pumping the liquid carbon dioxide to the appropriate pressure to return it to the combustor mentioned under 1),
(8) heating the $CO_2$ mentioned under 7) in the thermal recovery operation mentioned under 3).

The process of producing $O_2$ fed to the combustor belongs to the prior art, and cryogenic air distillation is typically employed for large amounts.

As for LAES technology, a description of the operation thereof is briefly reported here.

In the storage step, a LAES plant uses energy from renewable sources to produce liquid air.

During use, it obtains power from the previously stored liquid air.

The production of liquid air is known in the art.

The energy can be conveniently recovered from the liquid air either through the use of a thermal machine operating between the ambient temperature and the evaporation temperature of the liquid air, which is used as a heat sink or through the following process:

1) the liquid air is pumped at high pressure,
2) it is heated by heat exchange with a return air current,
3) it undergoes a final heating to a temperature close to ambient temperature,
4) it undergoes an expansion up to super-critical pressure through a power-producing machine,
5) part of the expanded air is sent to the exchanger mentioned under 2) above and re-liquefied,
6) the remaining part of the air undergoes further expansion, through a power generating machine, to low pressure, and before being released into the atmosphere, gives the frigories thereof in favor of the recycling current.

The current liquefied under 5) is laminated to the storage pressure: one part will evaporate and be released into the atmosphere after recovering the frigories, while the other part will remain stored.

Some sophisticated systems have been designed to limit the considerable energy expenditure required by the liquefaction of air; they range from the storage of frigories in a solid accumulator, to the coupling of a LAES system to an LNG vaporizer which produces natural gas, as shown for example in patents KR 102147234 B1 and CN 207420649 U.

These patents show the use of liquefied natural gas for liquefying a current of compressed air, using liquefied natural gas which must be imported from the outside; therefore, these systems actually consume liquefied natural gas which has been obtained using non-renewable energy sources.

Prior art document US 2011/100055 describes a "portable" system for producing large quantities of nitrogen and oxygen using a preliminary non-cryogenic step and a cryogenic purification.

Prior art document U.S. Pat. No. 5,832,748 describes a system for the cryogenic production of oxygen with low-purity.

Prior art document U.S. Pat. No. 6,131,407 describes the expansion of natural gas to generate the frigories necessary for the production of liquefied natural gas.

Prior art document CA 2,567,586 describes the cryogenic separation of air by means of a current of liquefied natural gas.

Prior art document US 2014/245779 describes a process for producing liquefied nitrogen in an Air Separation Unit (ASU) and liquefied $CO_2$ using liquefied natural gas.

SUMMARY OF THE INVENTION

The authors of the present invention have surprisingly developed a method which includes two steps: generation and storage; in the storage step, electricity and liquefied natural gas stored in the generation step are used to distill air and store liquid oxygen and oxygen-depleted air in liquid form.

During this step, at least a part or all of the liquefied natural gas is vaporized and fed into the network or, alternatively, stored.

In the generation step, a combined oxy-combustion cycle produces electricity, wherein one of the motor fluids for the secondary heat recovery cycle is represented by liquid oxygen-depleted air, which is vaporized at the expense of the natural gas taken from the network, thus transformed in liquefied natural gas.

OBJECT OF THE INVENTION

In a first object, the present invention describes a process for producing natural gas and for producing liquid oxygen and oxygen-depleted air in liquid form.

In a particular aspect of the invention, such a process is carried out within a method for stabilizing the power network, possibly using the excess electricity to produce said liquid oxygen and said liquid oxygen-depleted air.

In a second object, the present invention describes a process for generating or producing electricity and liquid carbon dioxide and, optionally, also liquid natural gas.

In a particular aspect of the invention, such a process is carried out within a method for stabilizing the power network, in particular, in periods of shortage of supply.

Overall, the present invention thus describes in a third object a method for stabilizing the power network and possibly for producing and storing LNG.

DETAILED DESCRIPTION OF THE INVENTION

Figure 1:
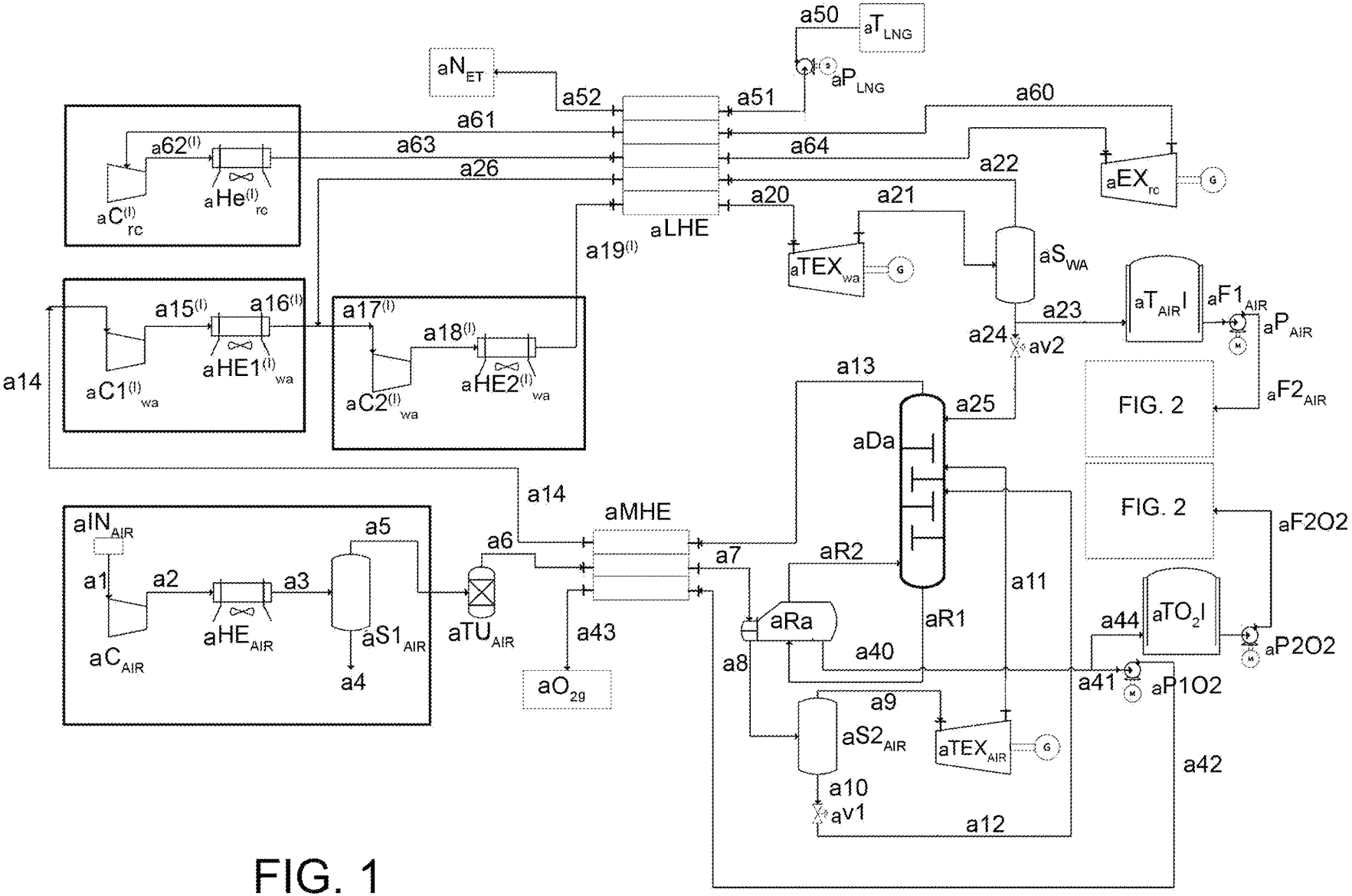
FIG. 1 shows the process of the invention according to a first aspect thereof in which electricity is stored (peak shaving) through the storage of liquid oxygen and liquid (oxygen) depleted air.
Figure 2:
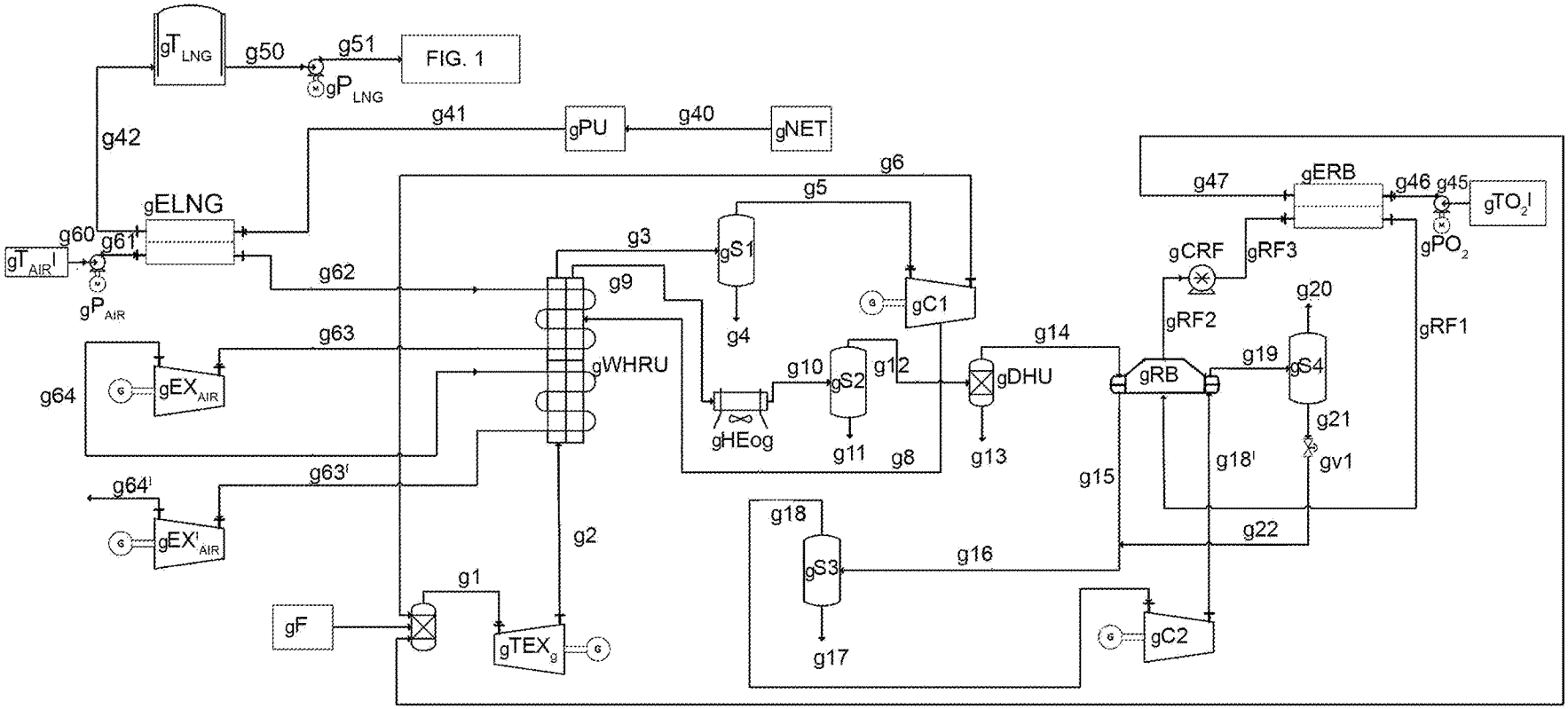
FIG. 2 shows the process of the invention in a second aspect thereof, in which the generation of electricity and possibly of liquefied natural gas is actuated.

In a first object, the present invention describes a process for producing natural gas and for producing liquid oxygen and liquid oxygen-depleted air.

Such a process comprises steps which involve:

an air cycle, a refrigeration cycle, and possibly a natural gas cycle.

For the purposes of the present invention, the aforementioned cycles are connected to one another by means of one or more heat exchange steps.

In a first aspect, the process of the invention achieves the storage step mentioned above (references to this aspect are preceded for convenience by "$_a$").

In particular, such a process comprises subjecting an air flow $_a$1 withdrawn from a source $_a IN_{air}$ to the steps of:

I) pre-treatment,

II) treatment,

III) heat exchange,

IV) separation, obtaining a flow of oxygen $_a$40 and an oxygen-depleted air flow $_a$13, Va) obtaining a liquid oxygen flow $_a$44 and a gaseous oxygen flow $_a$43 from said oxygen flow $_a$40, Vb) obtaining a liquid oxygen-depleted air flow $_a$13 from said oxygen-depleted air flow $_a$23.

More in detail, in such a pre-treatment step I) the air flow $_a$1 is subjected to the steps of:

Ia) compression in a compressor $_a C_{air}$, thus obtaining a compressed air flow $_a$2, Ib) cooling said compressed air flow $_a$2 in a cooler $_a HE_{air}$, thus obtaining a compressed and cooled air flow $_a$3, Ic) separation in a first separator $S1_{air}$ of a condensed vapor flow $_a$4 from the bottom of said separator $S1_{air}$ and of a compressed and cooled gaseous flow $_a$5 from the head of said separator $_a S1_{air}$.

In particular, in step Ib) the cooling is obtained by heat exchange with a cooling fluid, for example represented by air or water.

For the purposes of the present invention, steps Ia), Ib) and Ic) can be repeated several times, until a compressed and cooled gaseous air flow $_a$5 is obtained at the appropriate pressure for the subsequent operations.

The repetition of such steps shall be compatible with the necessary plant complexity and the consequent constructional and operating costs.

According to the treatment step II), the compressed and cooled gaseous flow $_a$5 is subjected to a purification in a Treatment Unit $_a TU_{air}$ for the removal of impurities, thus obtaining a purified air flow $_a$6.

For the purposes of the present invention, such impurities are represented by residual humidity, carbon dioxide, hydrocarbons, among which, in particular, acetylene.

In the subsequent heat exchange step III), the purified air flow $_a$6 is subjected to a step in which it is cooled to a temperature close to the condensation point thereof, with possible partial condensation, obtaining a purified and cooled air flow $_a$7.

Such a cooling is carried out in particular in the exchanger $_a$MHE.

In separation step IV) a preliminary step IVa) is carried out, in which the purified and cooled air flow $_a$7 is subjected to a further cooling inside the reboiler $_a$Ra of a distillation column $_a$Da obtaining a partially condensed flow $_a$8.

From said partially condensed flow $_a$8 inside a second separator $_a$S2$_{air}$ in a step IVb), a second condensed liquid air flow $_a$10 is separated from the bottom, which is laminated by a first lamination valve $_a$V1, thus obtaining a laminated current $_a$12 then fed to the same distillation column $_a$Da.

From the head of the second separator $_a$S2$_{air}$, a gaseous flow $_a$9 is instead separated, which is expanded in a turbine $_a$TEX$_{air}$ generating power and obtaining an expanded flow $_a$11 which is fed to the distillation column $_a$Da.

A flow of oxygen-depleted air $_a$13 is obtained from the head of the distillation column $_a$Da.

In a preferred aspect of the present invention, said oxygen-depleted air flow $_a$13 has an oxygen content of less than 12% v/v.

Advantageously, thereby, the oxygen content is less than the flammability limit of the liquefied natural gas, contributing to a greater safety of the process and of the plant in which it is carried out.

According to a possible embodiment, a column bottom current $_a$R1 is obtained from the bottom of the distillation column $_a$Da which is sent to the reboiler $_a$Ra of the column $_a$Da for step IV) to then be recirculated to the bottom of the column as flow $_a$R2; equivalent variants of such an embodiment can be implemented by those skilled in the art based on contingent needs.

In step Va), from the reboiler $_a$Ra a it is further obtained a liquid oxygen flow $_a$40, of which a first portion $_a$41 is pumped into a first oxygen pump $_a$P1O$_2$ thus obtaining a pumped flow $_a$42, which is subjected to a heat exchange step in the exchanger $_a$MHE wherein it is heated, obtaining a vaporized (gaseous) oxygen flow $_a$43.

A second portion $_a$44 of the liquid oxygen flow is sent to a liquid oxygen reservoir $_a$TO$_{21}$, in which it is stored and from which a use flow $_a$F1O$_2$ can be withdrawn, which can be pumped into a second oxygen pump $_a$P2O$_2$, thus obtaining a pumped use flow $_a$F2O$_2$.

In step Vb), the oxygen-depleted air flow $_a$13 is subjected to a heat exchange step in the exchanger a MHE, thus obtaining a heated oxygen-depleted air flow $_a$14.

Such a heated oxygen-depleted air flow $_a$14 is then subjected to the steps of:

compression, in a first compressor $_a$C1$_{wa}$, thus obtaining a compressed flow $_a$15, cooling, in a first cooler $_a$HE1$_{wa}$, thus obtaining a compressed and cooled flow $_a$16.

In particular, the cooling in the first cooler $_a$HE1$_{wa}$ is carried out using a refrigerant fluid represented for example by air or water.

The compression and cooling steps can be repeated one or more times depending on needs and taking into account the complexity of the plant and the operating and construction costs.

For example, the compressed and cooled flow $_a$16 can be compressed in a further first compressor $_a$C1'$_{wa}$, thus obtaining a further compressed flow $_a$15' to be cooled in a further first cooler $_a$HE1'$_{wa}$, thus obtaining a further first compressed and cooled flow $_a$16'.

In accordance with an embodiment of the present invention, said first compressed and cooled flow $_a$16 or said further first compressed and cooled flow $_a$16' can be rejoined with a heated recycled gas flow $_a$26, obtained as described below, generating a second flow $_a$17.

Said second flow $_a$17 is compressed in a second compressor $_a$C2$_{wa}$ to obtain a second compressed flow $_a$18 which is cooled in a second cooler $_a$HE2$_{wa}$, thus obtaining a second compressed and cooled flow $_a$19.

The compression and cooling steps can be repeated one or more times depending on needs and taking into account the complexity of the plant and the operating and construction costs.

For example, the second compressed and cooled flow $_a$19 can be compressed in a further second compressor $_a$C2'$_{wa}$, thus obtaining a further second compressed flow $_a$18', which can be cooled in a further second cooler $_a$HE2'$_{wa}$, thus obtaining a further second compressed and cooled flow $_a$19'.

Said further compressed and further cooled flow $_a$19/$_a$19' is subjected to a heat exchange step in the exchanger $_a$LHE with which it is cooled, obtaining an at least partially condensed flow $_a$20.

Said partially condensed flow $_a$20 is expanded in an expander $_a$TEX$_{wa}$ generating power and obtaining a further condensed flow $_a$21.

Inside a separator $_a$S$_{wa}$, a gaseous head flow $_a$22 is separated from said further condensed flow $_a$21 which, after being heated in a heat exchange step in the heat exchanger $_a$LHE, generates the heated recycled gas flow $_a$26 mentioned above.

A liquid oxygen-depleted air flow $_a$23 is obtained from the bottom of the separator $_a$S$_{wa}$, which is sent to a tank $_a$T$_{air}$ to be stored.

A flow $_a$F1$_{air}$ is obtained from such a tank $_a$T$_{air}$ which, after being pumped by a pump $_a$P$_{air}$, forms a use flow of pumped liquid oxygen-depleted air $_a$F2$_{air}$.

A portion of the oxygen-depleted air flow $_a$24 is laminated by a second lamination valve $_a$V2, thus obtaining a laminated flow $_a$25 at the head pressure of the distillation column $_a$Da and fed thereto.

For the purposes of the present invention, the frigories necessary for the heat exchange steps in the exchanger $_a$LHE can also be further provided by a refrigeration cycle.

According to an aspect of the present invention, such a refrigeration cycle is represented by a liquefied natural gas cycle.

In particular, a cooled and expanded liquefied natural gas flow $_a$60 obtained from an expansion step, for example in a liquefied natural gas expander $_a$EX$_{rc}$, carries out a heat exchange by releasing the frigories thereof by heat exchange in the exchanger $_a$LHE to the further compressed and further cooled flow $_a$19, generating a heated current $_a$61.

The heated current $_a$61 at the outlet of the exchanger LHE is compressed in a compressor of the refrigeration cycle $_a$C$_{rc}$, thus obtaining a compressed flow $_a$62 which is then cooled in a cooler of the refrigeration cycle $_a$HE$_{rc}$ obtaining a compressed and cooled flow $_a$63.

According to a particular aspect of the present invention, the compression and cooling in the refrigerant cycle can be repeated several times in a further compressor of the refrigeration cycle $_a$C'$_{rc}$, thus obtaining a further compressed flow $_a$62', possibly cooled in a further cooler $_a$HE'r$_c$ of the refrigeration cycle, until a cryogenic flow $_a$63 is obtained; the repetition of such steps depends on the needs and complexity of the plant and the construction and operating costs.

Said cryogenic flow $_a$63 is then further cooled by heat exchange in the heat exchanger $_a$LHE, thus obtaining a further cooled flow $_a$64, which, in a preferred aspect, is then expanded in the refrigeration cycle (or liquefied natural gas) expander $_aEX_{rc}$ with power production.

According to a particular aspect of the present invention, a further liquefied natural gas flow a 50 in output from a dedicated tank $_aT_{LNG}$ can be sent to the heat exchanger $_a$LHE and pumped by a liquefied natural gas pump $P_{LNG}$, thus obtaining a further pumped liquefied natural gas flow $_a$51.

The pumped liquefied natural gas flow $_a$51 heats up and vaporizes in the exchanger $_a$LHE, creating a further natural gas flow $_a$52 fed to the network.

Thus for the purposes of the present invention, heat exchanges are carried out between the purified air flow $_a$6, which is cooled to a cooled purified air flow $_a$7 (step III), the oxygen-depleted air flow $_a$13, which is heated to a heated oxygen-depleted air flow $_a$14 (step Vb), and the pumped oxygen flow $_a$42, which is heated and vaporized providing the vaporized oxygen flow $_a$43.

In particular, said heat exchanges are carried out in the exchanger $_a$MHE.

Thus for the purposes of the present invention, heat exchanges are carried out between the second compressed and cooled flow $_a$19 (or a further second compressed and cooled flow 19'), which is cooled to an at least partially condensed flow $_a$20, the gaseous head flow $_a$22, which is heated providing the heated gaseous recycled flow $_a$26, the cryogenic flow $_a$63, which is cooled to a further cooled flow $_a$64, the cooled and expanded natural gas flow $_a$60 providing the heated flow $_a$61, and possibly also between the pumped liquefied natural gas flow $_a$51, which is heated and vaporized giving the further natural gas flow $_a$52.

In particular, said heat exchanges are carried out in the exchanger $_a$LHE.

For the purposes of the present invention, the steps of the process described above are carried out using electricity.

In a second object, the present invention describes a process for producing electricity and liquid carbon dioxide; optionally and preferably also liquid natural gas.

Such a process comprises steps which involve:

an oxygen-depleted air cycle, a cycle by means of a refrigerant fluid, an oxygen cycle, and possibly a liquefied natural gas cycle.

For the purposes of the present invention, the aforementioned cycles are connected to one another by means of one or more heat exchange steps.

Such a process achieves the generation step mentioned above (references to this aspect are preceded by the "$_g$").

In particular, the combustion of a fuel $_g$F in a combustor $_g$COMB is obtained in a step A) in the presence of a carbon dioxide-rich recirculation flow $_g$6 and a gaseous oxygen flow $_g$47.

The combustion produces a combusted flow $_g$1 consisting mainly of $CO_2$ and water at high pressure and temperature, which is expanded in a power-producing expander $_g$TEX.

Preferably, the expansion is carried out up to almost atmospheric pressure, while the temperature is lowered to about 700° C.

The expanded combusted flow $_g$2 thus obtained in a step B) is subjected to a heat exchange in a Heat Recovery Unit $_g$WHRU in which it is cooled, obtaining an expanded and cooled flow $_g$3.

For the purposes of the present invention, the cooling is preferably carried out up to about 90° C.

Inside the Heat Recovery Unit $_g$WHRU, the heat exchange of step B) is carried out with a pumped oxygen-depleted air flow $_g$61 or pumped and heated flow $_g$62 and possibly also with a heated and expanded air flow $_g$64, which circulate within an air cycle, as it will be described below.

In a step C) the expanded and cooled flow $_g$3 is subjected to a separation step in a first separator $_g$S1 from the bottom of which a first portion $_g$4 of condensed water vapor is obtained.

A first gas flow $_g$5 is obtained from the head of said first separator $_g$S1, which is then compressed in a first compressor $_g$C1, from which a $CO_2$-rich recirculation flow $_g$6 is obtained, which is recirculated to the combustor $_g$COMB in order to decrease the combustion temperature.

A compressed flow $_g$8 is also obtained from the first compressor $_g$C1, which is sent to the Heat Recovery Unit $_g$WHRU, thus obtaining a cooled compressed flow $_g$9.

In a preferred aspect, the compressed flow $_g$8 is withdrawn from the first compressor $_g$C1 at a pressure of about 10 barg.

Inside the Heat Recovery Unit $_g$WHRU, the heat exchange is carried out with a pumped oxygen-depleted air flow $_g$61 or pumped and heated flow $_g$62, which circulates within an air cycle, as it will be described below.

In the case wherein the cooling inside the Heat Recovery Unit $_g$WHRU does not reach ambient temperature, it is possible to further cool the cooled compressed flow $_g$9 in a cooler $_gHE_{ag}$, by means of a refrigerant fluid represented for example by air or water, obtaining a further cooled flow $_g$10.

The cooled compressed flow $_g$9 or the further cooled flow $_g$10 is subjected to a separation step D) in a second separator $_g$S2 from whose bottom a second portion $_g$11 of condensed water vapor is obtained.

A flow $_g$12 with a main composition of carbon dioxide is obtained from the head of the second separator $_g$S2, which is subjected to a treatment step E) in a Dehydration Unit $_g$DHU wherein it is dehydrated by separating a flow from the bottom $_g$13 mainly consisting of condensed water and a dehydrated flow $_g$14 from the head.

For the purposes of the present invention, such a dehydration is carried out up to less than about 500 ppm and preferably up to less than about 50 ppm of water.

The dehydrated flow $_g$14 obtained is then subjected to a cooling step F) in a refrigerant bath $_g$RB, thus obtaining a cooled dehydrated flow $_g$15.

A second laminate flow with a main composition of $CO_2$ $_g$22 obtained as described below is joined to the cooled dehydrated flow $_g$15, thus obtaining a combined flow with a main composition of $CO_2$ $_g$16.

In a third separator $_g$S3 from such a combined flow with a main composition of $CO_2$ $_g$16 a flow of liquid $CO_2$ $_g$17 is separated from the bottom and a gaseous release flow $_g$18 is separated from the head.

In particular, such a liquid $CO_2$ flow $_g$17 consists of at least 95% $CO_2$.

In a step G) such a gaseous release flow $_g$18 can be compressed in a second compressor $_g$C2, thus obtaining a compressed gaseous release flow $_g$18'.

The gaseous release flow $_g$18 or the compressed gaseous release flow $_g$18' is sent to the refrigerant bath $_g$RB wherein it is cooled and partially condensed, obtaining a partially condensed release flow $_g$19.

A final gaseous release flow $_g$20 is separated in a step H) from such a partially condensed release flow $_g$19 in a fourth separator $_g$S4 which is released into the atmosphere, possibly after being further treated to reduce the carbon content thereof.

In particular, such a gaseous release flow $_g$20 mainly comprises argon, nitrogen, carbon dioxide and oxygen.

Instead, a recovery liquid flow $_g$21 is obtained from the bottom of the fourth separator S4, which is laminated by a first lamination valve $_g$V1, thus obtaining a laminated flow with a main composition of $CO_2$ $_g$22 to the pression of the third separator $_g$S3 and it is reunited with the cooled dehydrated flow $_g$15 as described above.

For the purposes of the present invention, the refrigerant bath $_g$RB operates on a refrigerant cycle in which a refrigerant fluid RF circulates.

In particular, such a refrigerant fluid is selected from the group comprising CF4, argon, R32, R41, R125 or another refrigerant fluid known in the field.

To this purpose, inside the refrigerant bath $_g$RB, the dehydrated flow $_g$14, as well as the gaseous release flow $_g$18 or the compressed gaseous release flow $_g$18', are cooled by a cooled flow $_g$RF1 of the refrigerant fluid, which heats up to obtain a heated refrigerant fluid flow $_g$RF2.

Such a heated refrigerant fluid flow RF2 is pumped into a refrigerant fluid cycle blower $_g$CRF providing a pumped refrigerant fluid flow $_g$RF3, which is then cooled in the heat exchanger by an oxygen cycle $_g$Erb, thus obtaining a cooled refrigerant fluid flow $_g$RF1.

In particular, the oxygen cycle originates from a tank $_g$$TO_2$ where liquid oxygen is stored.

In fact, a liquid oxygen flow $_g$45 originates from the tank $_g$$TO_2$ which is pumped by an oxygen pump $_g$$PO_2$, thus obtaining a pumped liquid oxygen flow $_g$46.

Such a pumped liquid oxygen flow $_g$46 carries out a heat exchange step in the oxygen cycle exchanger $_g$Erb, transferring the frigories thereof to the pumped refrigerant fluid flow $_g$RF3, thus obtaining a gaseous oxygen flow $_g$47.

The gaseous oxygen flow $_g$47 thus obtained is sent to the combustor $_g$COMB as described above.

In an aspect of the invention, the oxygen flow sent to the combustor $_g$COMB is characterized by high purity >95%.

Therefore, for the purposes of the present invention, the dehydrated flow $_g$14 is indirectly cooled by the pumped liquid oxygen flow $_g$46, through the refrigerant fluid in the refrigerant bath $_g$RB.

As reported above, inside the Heat Recovery Unit $_g$WHRU, heat exchanges are carried out with one or more oxygen-depleted air flows circulating within an oxygen-depleted air circuit.

In particular, from an oxygen-depleted air tank $_g$$T_{air}$, an oxygen-depleted air flow $_g$60 is withdrawn which is pumped by a pump $_g$$P_{air}$ thus obtaining a pumped oxygen-depleted air flow $_g$61.

In a preferred aspect, the pumping is carried out up to a pressure of about 80 barg.

Such a pumped oxygen-depleted air flow $_g$61, before being sent to the Heat Recovery Unit $_g$WHRU, can perform a heat exchange in a natural gas exchanger $_g$ELNG with a purified natural gas flow $_g$41 obtained as described below, obtaining a pumped heated oxygen-depleted air flow $_g$62.

The oxygen-depleted air flow $_g$61 or the heated oxygen-depleted air flow $_g$62 is sent to the Heat Recovery Unit $_g$WHRU in which it performs a heat exchange with the compressed flow $_g$8 and the expanded combusted flow $_g$2, thus obtaining a further heated oxygen-depleted air flow $_g$63.

In an embodiment of the invention, such a further heated oxygen-depleted air flow $_g$63 can optionally be expanded in a first expander $_g$$EX_{air}$ with power generation, obtaining a further heated expanded oxygen-depleted air flow $_g$64.

Such a further heated expanded oxygen-depleted air flow $_g$64 can be sent again to the Heat Recovery Unit $_g$WHRU for further heat exchange with the expanded combusted flow $_g$2, thus obtaining an even further heated oxygen-depleted expanded air flow $_g$63'.

In a preferred aspect of the present invention, the further heated oxygen-depleted air flow $_g$63 or the even further heated expanded oxygen-depleted air flow $_g$63' exits the Heat Recovery Unit $_g$WHRU with a temperature of about 450-500° C.

Before being released into the atmosphere, it can possibly be further expanded in a further expander $_g$$EX'_{air}$ with power generation, achieving an oxygen-depleted release air flow $_g$64'.

Alternatively, such an oxygen-depleted release air flow $_g$64' can be used in the regeneration of the Air Treatment Unit ($_g$TUair) or in the Natural Gas Purification Unit ($_g$PU) or in the carbon dioxide Dehydration Unit ($_g$DHU).

According to an embodiment of the present invention reported above, the pumped oxygen-depleted air flow $_g$61 can be heated in a liquefied natural gas heat exchanger $_g$ELNG by a purified natural gas flow $_g$41 obtained from a natural gas Purification Unit $_g$PU operating on an initial natural gas flow $_g$40 taken from the network $_g$Net, normally at a pressure of about 70 barg.

In the Purification Unit $_g$PU the initial natural gas flow $_g$40 is treated according to methods known in the field in order to (i) reduce its water content, preferably below 500 ppm of water and even more preferably below 50 ppm and/or (ii) to reduce its sulfur content, preferably below 500 ppm of sulfur and even more preferably below 10 ppm and/or (iii) to reduce its carbon dioxide content, preferably below 500 ppm of carbon dioxide and even more preferably below 50 ppm.

After the heat exchange step in the exchanger g ELNG, the condensed natural gas flow $_g$42 obtained is sent to a tank $_g$TLNG wherein it is properly stored.

According to the need, a liquefied natural gas flow $_g$50 can be taken from such a tank $_g$TLNG, which can be pumped by a liquefied natural gas pump $_g$$P_{LNG}$ resulting in a pumped liquefied natural gas flow $_g$51.

For the purposes of the present invention, the liquid oxygen-depleted air flow employed in the heat exchange step in the exchanger $_g$ELNG for cooling the purified natural gas flow $_g$41 and in the heat exchange with the expanded combusted flow $_g$2 in the Heat Recovery Unit ($_g$WHRU) is the liquid oxygen-depleted air obtained from the storage step and, in particular, from the separation step Vb) in the separator $_a$$S_{wa}$ of the oxygen-depleted air cycle and stored in the tank $_a$$T_{air}$.

For the purposes of the present invention, the liquid oxygen used in the heat exchange step in the exchanger $_g$Erb of the liquid oxygen cycle for cooling the pumped refrigerant fluid flow $_g$RF3 is the liquid oxygen $_a$40 obtained from the generation step and, in particular, output the reboiler $_a$Ra of the distillation column $_a$Da and (or the portion $_a$44 thereof) stored in the tank $_a$$TO_2$.

For the purposes of the present invention, the liquefied natural gas obtained after the heat exchange with oxygen-depleted air is stored within an appropriate tank $_g$$T_{LNG}$, and, after being taken as a flow $_g$50 and pumped giving the pumped flow $_g$51, can be used to supply the additional refrigeration units necessary for the heat exchange carried out in the heat exchanger $_a$LHE of the storage process described above.

The liquid or gaseous products obtained in accordance with the storage step and with the generation step according to the present invention are stored in appropriate tanks which coincide with each other; in other words, the liquefied natural gas tank ($T_{LNG}$), the liquid oxygen-depleted air tank ($T_{AIR}$), the liquid oxygen tank ($T_{O2}$) of the storage step coincide with the corresponding tanks of the generation (or production) step.

For the purposes of the present invention, in the above description, the pressure values are preferably to be understood as follows:

LNG: 5-150 barg, approximately, and preferably 70 barg;

oxygen and the recycling current to the combustor: 8-450 barg, approximately, and preferably 35 barg;

oxygen-depleted air: 10-400 barg, approximately, and preferably 150 barg;

dehydrated carbon dioxide: it is between triple point pressures and the critical pressure of $CO_2$.

In light of the above, it is apparent that the processes described are integrated and connected to one another.

In particular, the first process ("STORAGE") is preferably carried out in a condition of electricity supply exceeding demand (excess) and allows the preparation and storage of liquefied oxygen-depleted air, of liquefied oxygen; as well as the production of natural gas to be introduced into the network.

In a particular aspect of the invention, the first process is carried out within a method for stabilizing the power network, in particular in situations of excess of electricity.

Such a method comprises carrying out the first process using an amount of electricity exceeding the demand.

Furthermore, the second process ("GENERATION") is preferably carried out under conditions of demand for electricity with respect to demands (shortage) and allows the production of electricity in several steps, as well as the preparation and storage of liquefied natural gas.

In a particular aspect of the invention, the second process is carried out in the context of a method for stabilizing the power network, in particular, in periods of under-supply.

Such a method comprises carrying out the second process using a storage of liquid (oxygen) depleted air and liquid oxygen stored under conditions of excess electricity or, as described above, by means of a "STORAGE" process.

In a third object of the invention, a method for stabilizing the power network is described, comprising implementing the "STORAGE" process and the "GENERATION" process according to the conditions and availability of electricity, advantageously further leading to the production and storage of LNG.

From the description provided above, the several advantages offered by the present invention will be apparent to those skilled in the art.

The method described by the present invention allows high efficiency; for example, 90% with respect to fuel, 45% overall efficiency (i.e., taking into account all the forms of energy fed into the system).

Furthermore, the method is capable of stabilizing the power network by absorbing excess energy or by introducing produced energy.

The method can also conveniently produce liquefied natural gas and gaseous oxygen at high pressure.

The method described by the present invention allows not releasing carbon dioxide into the environment, allowing the implementation of an environmentally sustainable process.

Overall, the method comprises processes which are simpler, from a technical point of view, than the sum of the other processes which lead to the same results, such as oxy-combustion and LAES technologies, for example also due to the use of a single distillation column.

What is claimed is:

1. A process for producing liquid oxygen and liquid oxygen-depleted air, and optionally natural gas, said process using electricity said process comprising subjecting an air flow withdrawn from a source to the steps of:

I) pre-treatment, wherein the air flow is subjected to the steps of:

Ia) compression in a compressor, obtaining a compressed air flow,

Ib) cooling of said compressed air flow in a cooler, obtaining a compressed and cooled air flow, and Ic) separation in a first separator of a condensed vapor flow from the bottom of said separator and of a compressed and cooled gaseous flow from a head of said first separator, II) treatment, wherein the compressed and cooled gaseous flow is subjected to one or more purification operations to obtain a purified air flow, III) heat exchange, wherein the purified air flow is subjected to thermal exchange with a cooling medium, obtaining a purified and cooled air flow, IV) separation, comprising the following sub-steps:

wherein a preliminary step IVa) is carried out, in which the purified and cooled air flow is subjected to cooling inside a reboiler of a distillation column, obtaining a partially condensed flow from which, in a step IVb), a second condensed liquid air flow is separated within a second separator from a bottom of the second separator, and laminated by a first lamination partially vaporized by a first valve, thereby obtaining a partially vaporized current that is fed to the distillation column, and a gaseous flow is separated from a head of said second separator and expanded in a turbine with power generation, obtaining an expanded flow that is fed to the distillation column, obtaining an oxygen flow from the reboiler, a second portion of the oxygen flow being sent to a first tank, and an oxygen-depleted air flow is obtained from a head of said distillation column, Va) obtaining a liquid oxygen flow and a gaseous oxygen flow from said oxygen flow, Vb) obtaining a liquid oxygen-depleted air flow from said oxygen-depleted air flow, wherein in step Vb), the oxygen-depleted air flow is subjected to a first heat exchange step, obtaining a heated oxygen-depleted air flow, which is subjected to steps of:

compression, obtaining a compressed flow, cooling, obtaining a compressed and cooled flow, to which a heated recycled gas flow is added, obtaining a second flow, which is compressed, obtaining a second compressed flow, which is cooled, obtaining a further compressed and further cooled flow, which is subjected to a second heat exchange step in a heat exchanger with which the further compressed and further cooled flow is cooled, obtaining an at least partially condensed flow, which is expanded in an expander, obtaining a further condensed flow and with power generation, from which inside a third separator, separating a gaseous head flow from a head of the third separator from the liquid oxygen-depleted air flow from a bottom of the third separator, the gaseous head flow being heated in a third heat exchange step within the heat exchanger to provide the heated recycled gas flow and the liquid oxygen-depleted air flow from the bottom of said third separator is sent to a second tank for the liquid oxygen-depleted air, wherein the second and third heat exchange steps in the heat exchanger are carried out using frigories of a refrigeration cycle that uses liquefied natural gas.

2. The process of claim 1, wherein in step II), the compressed and cooled gaseous flow is subjected to purification in a treatment unit for removal of impurities, thus obtaining the purified air flow.

3. The process of claim 2, wherein in step III) the purified air flow is subjected to a heat exchange step with which the purified air flow is cooled, thus obtaining the purified and cooled air flow.

4. The process of claim 1, wherein the second and third heat exchange steps in the heat exchanger are carried out by further using frigories of a liquefied natural gas flow.

5. A method for stabilizing a power network, the method comprising using available electricity from the power network to carry out the process for producing liquid oxygen and liquid oxygen-depleted air, and optionally natural gas, of claim 1.

6. The method of claim 5, wherein the liquid oxygen-depleted air flow is pumped by an oxygen-depleted air pump, obtaining a pumped oxygen-depleted air flow, which is heated by heat exchange with a purified natural gas flow generated within the process for producing liquid oxygen and liquid oxygen-depleted air, and optionally natural gas, said process carried out using electricity.

* * * * *